US006751921B1

(12) United States Patent
Iwakawa

(10) Patent No.: US 6,751,921 B1
(45) Date of Patent: Jun. 22, 2004

(54) EARTHQUAKE-PROOFING REINFORCING METAL FITTING

(75) Inventor: Toru Iwakawa, Tokyo (JP)

(73) Assignee: Nippon Eisei Center Co., Ltd., Tokyo (JP)

( * ) Notice: Subject to any disclaimer, the term of this patent is extended or adjusted under 35 U.S.C. 154(b) by 0 days.

(21) Appl. No.: 09/913,834

(22) PCT Filed: Jan. 25, 2000

(86) PCT No.: PCT/JP00/00360

§ 371 (c)(1),
(2), (4) Date: Dec. 6, 2001

(87) PCT Pub. No.: WO01/55519

PCT Pub. Date: Aug. 2, 2001

(51) Int. Cl.[7] ..... E04B 1/38

(52) U.S. Cl. ..... 52/713; 248/65; 248/174; 248/218.4; 248/220.1; 248/499

(58) Field of Search ..... 248/65, 118, 160, 248/440.1, 174, 218.4, 220.1, 300, 499; 297/297, 303.3, 302.5

(56) References Cited

U.S. PATENT DOCUMENTS 4,714,219 A * 12/1987 Mayse ..... 248/65
4,744,192 A * 5/1988 Commins ..... 51/714
4,749,230 A * 6/1988 Tornero ..... 297/353
5,092,097 A * 3/1992 Young ..... 52/702
5,188,317 A * 2/1993 Roth ..... 248/59
5,685,609 A * 11/1997 Miotto ..... 248/118.3
6,050,035 A * 4/2000 Thompson et al. ..... 52/167.1
6,247,274 B1 * 6/2001 Thompson et al. ..... 52/167.1
6,264,276 B1 * 7/2001 Chen ..... 297/353
6,415,560 B1 * 7/2002 Rinderer ..... 52/167.1
6,421,965 B2 * 7/2002 Thompson et al. ..... 52/167.1

* cited by examiner

*Primary Examiner*—Carl D. Friedman
*Assistant Examiner*—Yvonne M. Horton
(74) *Attorney, Agent, or Firm*—Sughrue Mion, PLLC

(57) ABSTRACT

The reinforcing holder against vibrations has the vibration-proof performance further enhanced as compared with prior art so that a wooden building is not broken down even if strong vibrations are loaded by an earthquake, a typhoon or the like. The reinforcing holder against vibrations 1 comprises an L-shaped base member 2 formed by bending a plate and formed with curved and projecting parts 5*a* and 5*b* which are curved inward in intermediate parts of both piece parts 2*a* and 2*b*, a reinforcing member 3 formed by bending a plate and placed in contact with a bent part of the L-shaped base member 2, and absorbing members 4 formed of rubber material which has excellent elastic characteristics and water resistance and stopped at a plurality of locations of the L-shaped base member 2. When the reinforcing member 3 is placed in contact with the L-shaped base member 2, a clearance 10 is formed between a bent corner part 3*c* of the reinforcing member 3 and a bent corner part 2*c* of the L-shaped member 2.

7 Claims, 4 Drawing Sheets

PRIOR ART

EARTHQUAKE-PROOFING REINFORCING METAL FITTING

TECHNICAL FIELD

The present invention relates to a reinforcing holder against vibrations mounted on the joining part of structural members such as foundations, columns, cross-beams, beams or the like to reinforce them so that a wooden building may not be broken down even if strong vibrations are loaded thereupon by an earthquake, a typhoon or the like.

BACKGROUND ART

So far, as methods of reinforcing the joining part of structural members of a wooden building, there have been various methods employed: providing bracings or horizontal braces, or mounting clamps or L-shaped metal fittings.

However, in such conventional methods as described above, no sufficient reinforcing effect can be obtained in a case where strong vibrations are loaded by an earthquake, a typhoon or the like, and the structural members tend to be easily disjoined or sustain damage in the joining part so that wooden buildings sometime may break in the joining parts, or in a severe case, the buildings may fall down.

In view of the foregoing, the reinforcing holder against vibrations 51 shown in FIG. 4 has been devised and used to sufficiently withstand even strong vibrations caused by an earthquake, a typhoon or the like.

The reinforcing holder against vibrations 51 comprises an L-shaped base member 52 formed by bending a plate formed of high tension steel in the form of an L-shape and formed with bent and swelled parts 53*a* and 53*b* bent inward in intermediate parts of both piece parts 52*a* and 52*b*, a reinforcing member 54 formed by bending a plate formed of high tension steel and fixedly mounted by welding on a bent corner part 52*c* of the L-shaped base member 52, and absorbing members 55 formed of rubber or the like stopped at several locations of the L-shaped base member 52.

According to the above-described arrangement, both strong vertical and horizontal vibrations can be absorbed by the whole L-shaped base member 52 and its bent and swelled parts 53*a* and 53*b*, and deformation of the L-shaped base member 52 can be removed by the reinforcing member 54 and whereby the original shape thereof can be restored. Therefore, even if strong vibrations are loaded, a wooden building is not easily broken down in the joining parts or does not fall down.

However, in the above-described reinforcing holder against vibrations 51, since the intermediate parts of both piece parts 52*a* and 52*b* are bent inward to the flat bent and swelled parts 53*a* and 53*b*, the effect of absorbing normal vibrations and vertical oscillations is insufficient.

Further, since the reinforcing member 54 is fixedly mounted by welding on the L-shaped base member 52, and the bent corner part 52*c* of the L-shaped base member 52 and the bent corner part 54*c* of the reinforcing member 54 are placed in close contact, the amount of elastic deformation is small, and the effect of removing the deformation of the L-shaped base member 52 and restoring the original shape thereof is also insufficient.

Furthermore, since the reinforcing member 54 is fixedly mounted, excessive load is applied to any parts of the reinforcing member 54 or stress concentration is generated so that fastening bolts may fly, or the reinforcing member 54 itself may fly, or cracks may occur in the reinforcing members 54.

DISCLOSURE OF INVENTION

The present invention has been accomplished in order to solve such problems as noted above with respect to prior art.

It is an object of the present invention to provide a reinforcing holder against vibrations which further enhances the vibration proof performance by further enhancing the effect of absorbing normal vibrations and vertical oscillations, further enhancing the effect of removing deformation of an L-shaped base member and restoring the original shape thereof, and preventing fastening bolts and a reinforcing member itself from flying and cracks from occurring in the reinforcing member to the utmost so that a wooden building may not be broken down even if strong vibrations are loaded by an earthquake, a typhoon or the like.

For achieving the aforementioned object, the reinforcing holder against vibrations according to the present invention comprises an L-shaped base member formed by bending a plate and formed with curved and projecting parts which are curved inward in intermediate parts of both piece parts, a reinforcing member formed by bending a plate and placed in contact with a bent part of the L-shaped base member, and absorbing members formed of rubber material which has excellent elastic characteristics and water resistance and stopped at several locations of the L-shaped base member.

Further, preferably, when the reinforcing member is placed in contact with the L-shaped base member, a clearance is present between a bent corner part of the reinforcing member and a bent corner part of the L-shaped base member.

If both the piece parts of the reinforcing member have the length whose both end lines assume, when the reinforcing member is placed in contact with the L-shaped base member, approximately the same position as the bent lines of the curved and projecting parts, the movement of the reinforcing member is controlled by the bent lines to prevent severe backlash from occuring.

It is more preferable that the plate is formed of high tension steel, since it is excellent in tensile strength, weldability, notch toughness, workability and corrosion resistance.

BEST MODE FOR CARRYING OUT THE INVENTION

Preferred embodiments of the reinforcing holder against vibrations according to the present invention will be described hereinafter with reference to the drawings.

Figure 1:
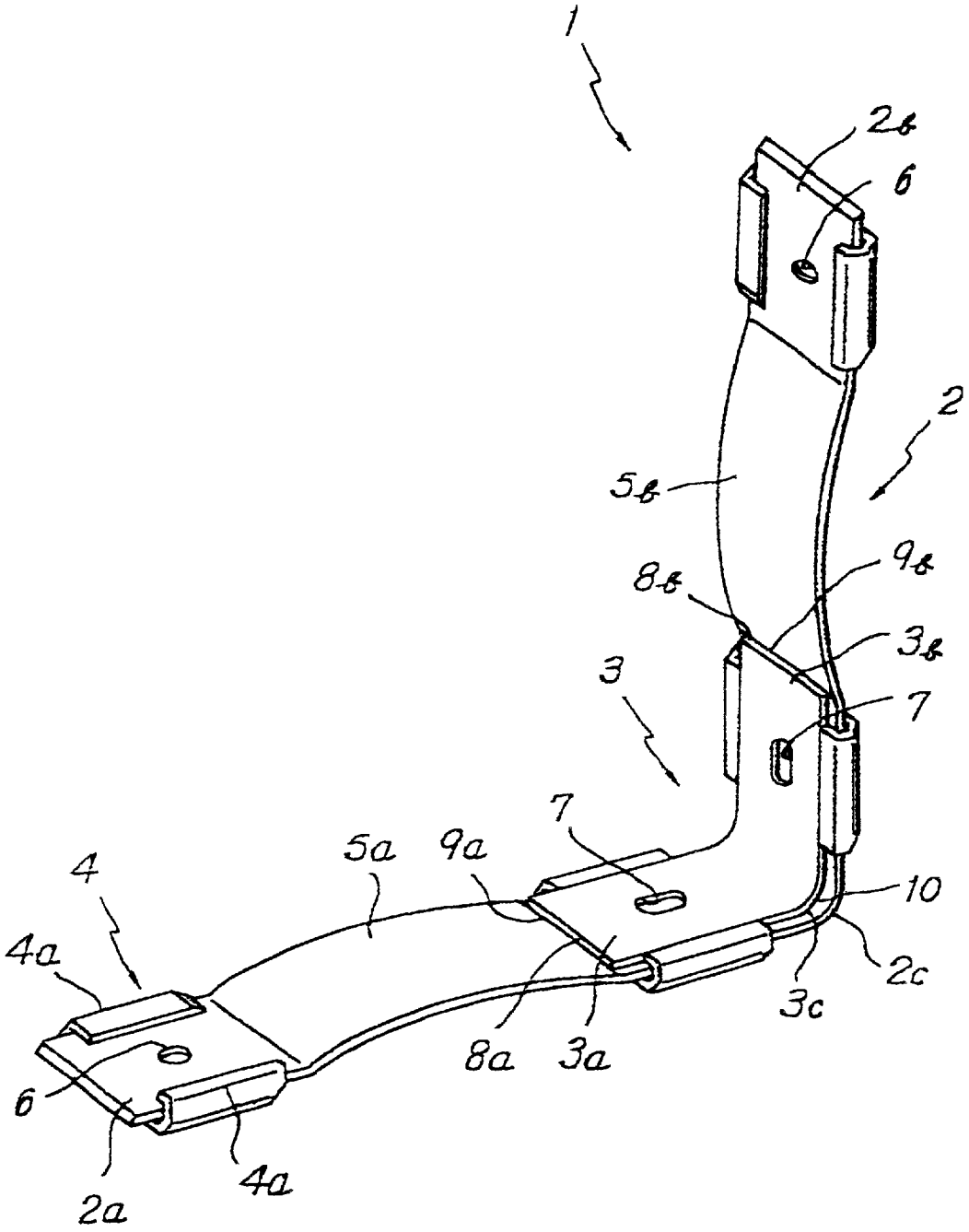
FIG. 1 is a perspective view of the reinforcing holder against vibrations according to the present invention.
Figure 2:
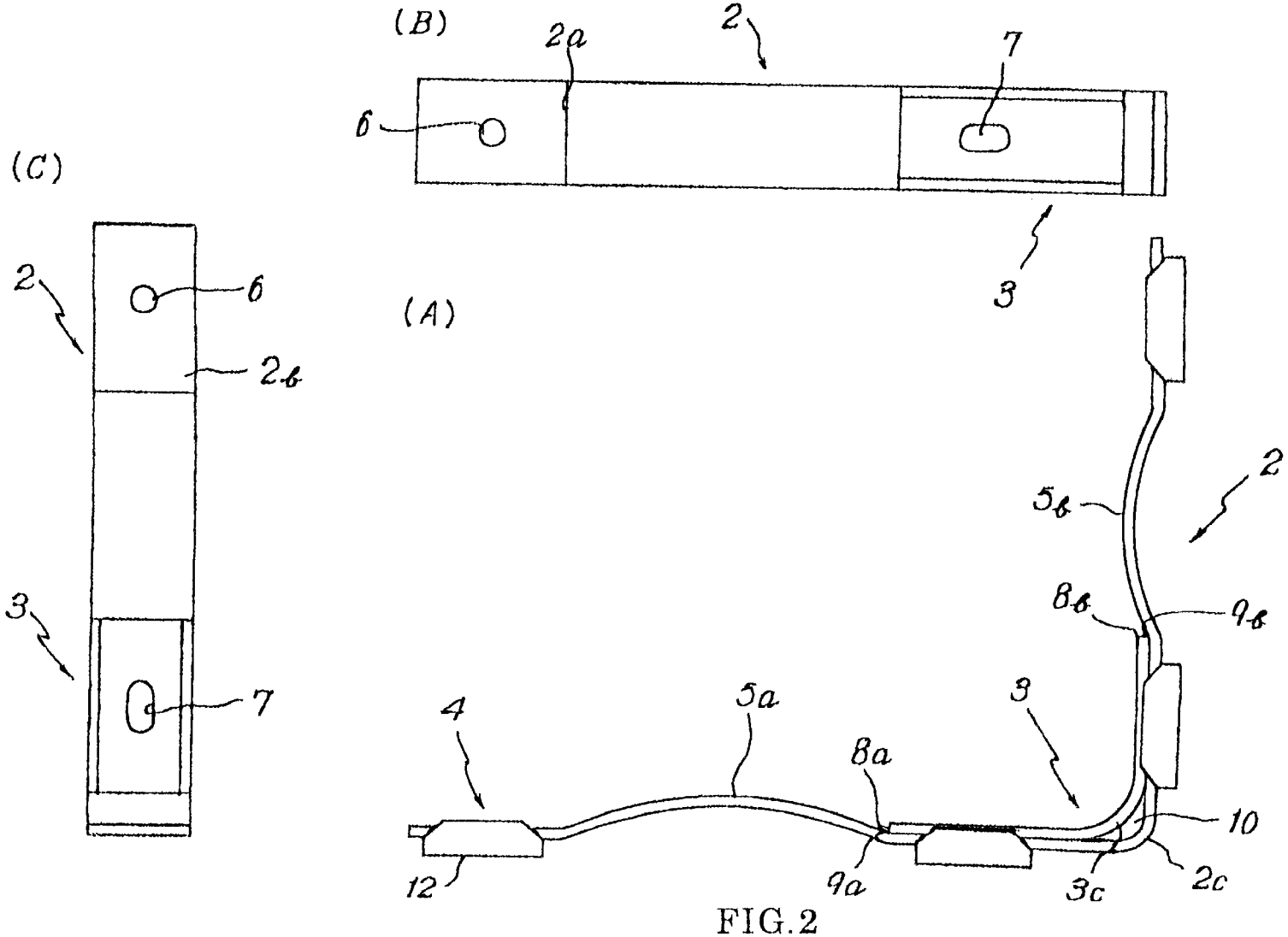
FIG. 2 (A) is a front view of the reinforcing holder against vibrations according to the present invention, FIG. 2 (B) is a plan view and FIG. 2 (C) is a side view.

The reinforcing holder against vibrations 1 comprises an L-shaped base member 2, a reinforcing member 3, and absorbing members 4, as shown in FIGS. 1 and 2.

The L-shaped base member 2 is formed in the form of an L-shape by bending a plate formed of iron and steel material, and curved and projecting parts 5*a* and 5*b* curved inward are formed in intermediate parts of both piece parts 2*a* and 2*b*.

Preferably, construction steel is employed for iron and steel material, and particularly preferably, high tension steel is employed.

High tension steel is obtained by adding to low carbon steel a small quantity of a suitable combination of alloy elements such as manganese, silicon, nickel, chrome and molybdenum or the like. Generally, high tension steel has tensile strength of not less than 50 kg/mm$^2$ and yield point of not less than 30 kg/mm$^2$ and is excellent in weldability, notch toughness, workability and corrosion resistance.

Insert holes 6 and 6 are bored in the vicinity of both end parts of both piece parts 2*a* and 2*b* and a bent corner part 2*c*.

The reinforcing member 3 is formed in the form of an L-shape by bending a plate formed of iron and steel material, and slots 7 and 7 are bored in both piece parts 3*a* and 3*b*.

Preferably, construction steel is likewise employed for iron and steel material, and particularly preferably, high tension steel is employed.

Both piece parts 3*a* and 3*b* have the length whose both end lines 8*a* and 8*b* assume, when the reinforcing member 3 is placed in contact with the L-shaped base member 2, approximately the same position as bent lines 9*a* and 9*b* of the curved and projecting parts 5*a* and 5*b*.

The radius of curvature $r_2$ of the outer surface of the bent corner part 3*c* of the reinforcing member 3 is larger than the radius of curvature $r_1$ of the inner surface of the bent corner part 2*c* of the L-shaped base member 2, whereby when the reinforcing member 3 is placed in contact with the L-shaped base member 2, a clearance 10 is formed between the bent corner part 3*c* of the reinforcing member 3 and the bent corner part 2*c* of the L-shaped base member 2.

The absorbing member 4 is formed of rubber material such as isoprene rubber (NR), butadiene rubber (BR) or the like, both side parts of which are key-like stopper parts 4*a* so that the former can be stopped at the L-shaped base member 2.

Further, a slot 11 is formed in the central part of the absorbing member 4, and several anti-skid groove parts 12, 12, . . . are formed on the outer surface.

The reinforcing holder against vibrations 1 according to the present invention is constituted as described above and exhibits the intended operation and effect by using it in the following manner.

Figure 3:
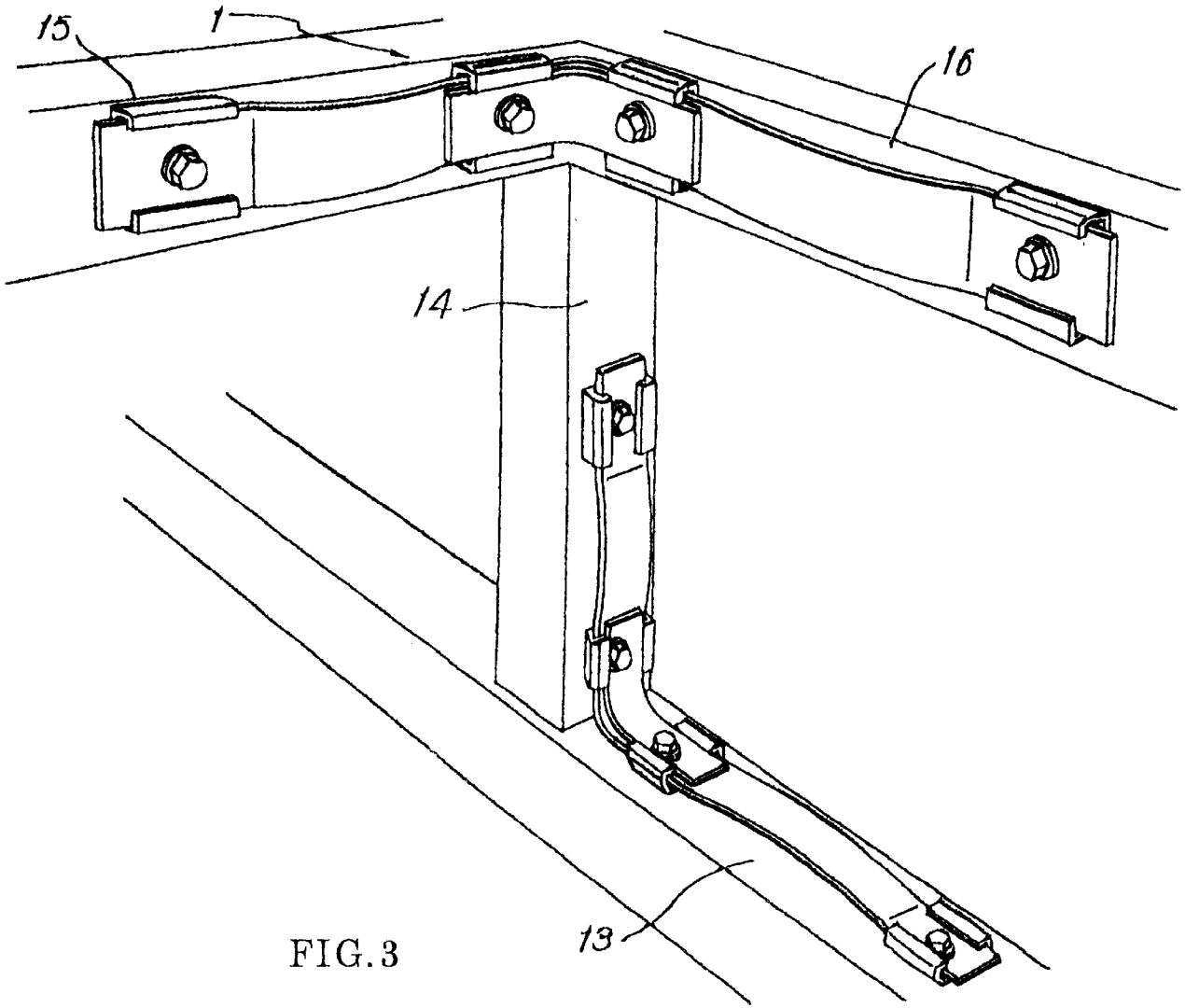
FIG. 3 is a using status view of the reinforcing holder against vibrations according to the present invention.
Figure 4:
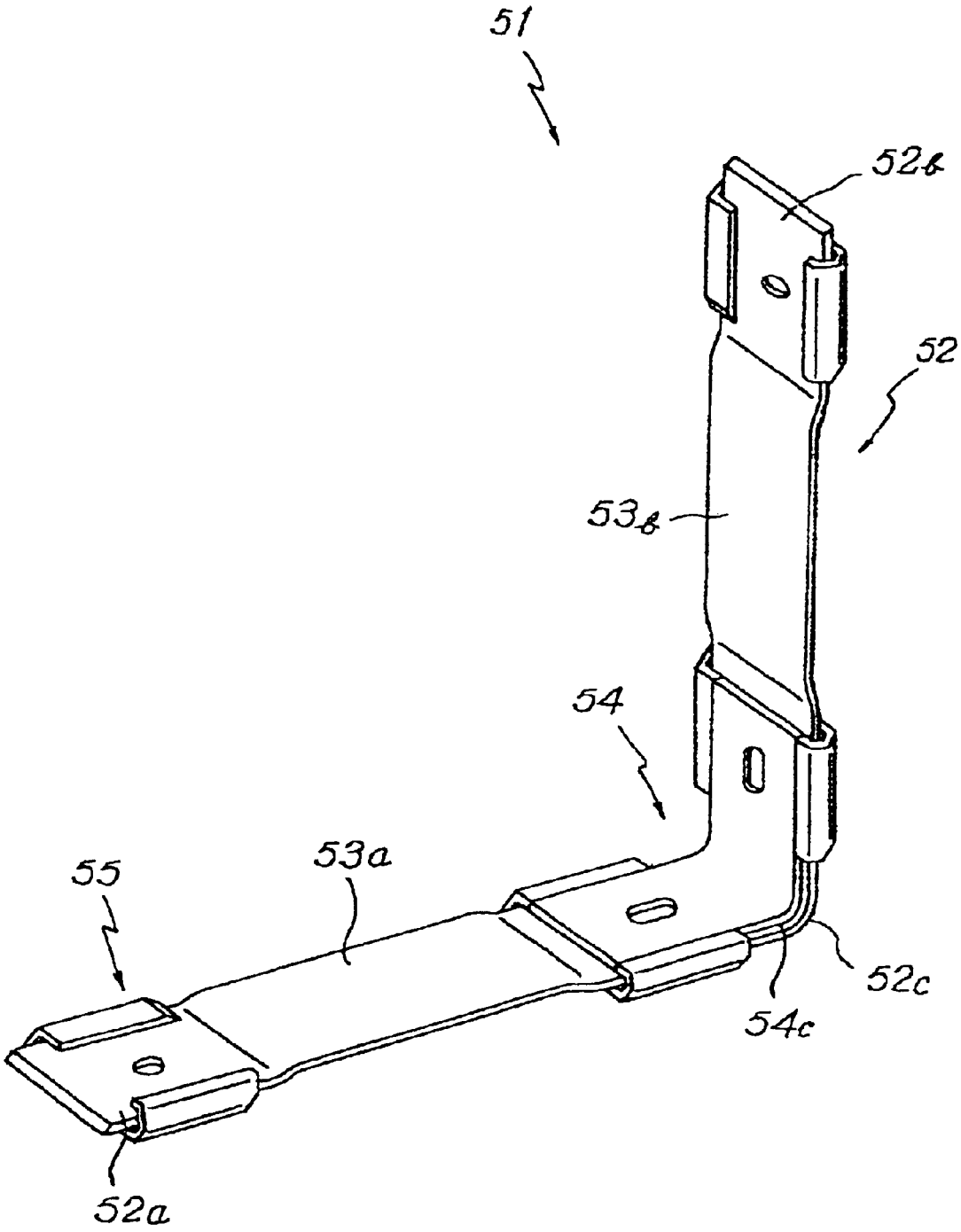
FIG. 4 is a perspective view of a conventional reinforcing holder against vibrations.

As shown in FIG. 3, the absorbing members 4 stopped at both piece parts 2*a* and 2*b* of the L-shaped base member 2 are placed in contact with the side surfaces of a foundation 13 and a column 14, bolts are inserted into the insert holes 6, 6, . . . , the slots 7, 7, and the slots 11, 11, . . . and are tightened by nuts, and the reinforcing holder against vibrations 1 is mounted on the joining part between the foundation 13 and the column 14.

The L-shaped base member 2 is formed with the curved and projecting parts 5*a* and 5*b*, and since the curved and projecting parts 5*a* and 5*b* are easily expansively and contractively deformed and are also easily torsionally deformed, even if normal vibrations and vertical oscillations are loaded, the curved and projecting parts 5*a* and 5*b* are elastically deformed, whereby vibrations and oscillations can be absorbed sufficiently.

Further, the reinforcing member 3 is not fixedly mounted on the L-shaped base member 2, and the clearance 10 is formed between the bent corner part 3*c* of the reinforcing member 3 and the bent corner part 2*c* of the L-shaped base member 2. Therefore, when the L-shaped base member 2 is deformed, the reinforcing member 3 is elastically deformed greatly as a separate member to significantly enhance the effect of removing deformation of the L-shaped base member 2 and restoring the original shape thereof.

Moreover, the reinforcing member 3 is not fixedly mounted on the L-shaped base member 2, and the clearance 10 is present between the bent corner part 3*c* of the reinforcing member 3 and the bent corner part 2*c* of the L-shaped base member 2. Therefore, no excessive loads are applied to any parts of the reinforcing member 3 as compared with prior art, and stress concentration is hard to be generated so that the bolts hardly fly, or the reinforcing member 3 itself hardly flies, or cracks hardly occur in the reinforcing member 3.

Furthermore, both piece parts 3*a* and 3*b* of the reinforcing member 3 have the length whose both end lines 8*a* and 8*b* assume, when the reinforcing member 3 is placed in contact with the L-shaped base member 2, approximately the same position as bent lines 9*a* and 9*b* of the curved and projecting parts 5*a* and 5*b*. Therefore, even if the reinforcing member 3 should be elastically deformed as a separate member, the movement is controlled by the bent lines 9*a* and 9*b* to prevent severe backlash from occuring.

Further, since no work for welding the reinforcing member 3 to the L-shaped base member 2 is necessary, the manufacturing process of the reinforcing holder against vibrations 1 is simplified to lower the manufacturing cost.

While in the above-described embodiment, the L-shaped base: member 2 has been formed by bending a single plate, it is noted that the L-shaped base member 2 may be formed by superposing and fixing two bent plates.

According to the constitution as described above, the effect of absorbing vibrations and oscillations is further enhanced.

It is noted that, as shown in FIG. 3, the reinforcing holder against vibrations 1 may be also mounted on the joining part between beams 15 and 16 in the manner similar to the aforementioned and may be also mounted on any joining part similarly.

What is claimed is:

1. A reinforcing holder against vibrations comprising:

an L-shaped base member formed by bending a plate to define a bent part and plural curved and projecting parts, at least one curved and projecting part being curved inward in an intermediate part;

a reinforcing member formed by bending a plate and placed in contact with at least a portion of each of said curved and projecting parts proximate said bent part of the L-shaped base member; and absorbing members formed of rubber material which have excellent elastic characteristics and water resistance, and disposed at several locations, on the L-shaped base member.

2. The reinforcing holder against vibrations according to claim 1, wherein, when the reinforcing member is placed in contact with the L-shaped base member, a clearance is present between a bent comer part of the reinforcing member and a bent comer part of the L-shaped base member.

3. The reinforcing holder against vibrations according to claim 1 or 2, wherein the reinforcing member defines at each of its distal ends an end line which is proximate a bent line defining a beginning of a curved and projecting part of a respective one of said intermediate parts when the reinforcing member is placed in contact with the L-shaped base member.

4. The reinforcing holder against vibrations according to claim 1, wherein said plate is formed of high tension steel.

5. The reinforcing holder against vibrations according to claim 2, wherein said plate is formed of high tension steel.

6. The reinforcing holder against vibrations according to claim 3, wherein said plate is formed of high tension steel.

7. The reinforcing holder against vibrations according to claim 1, wherein said reinforcing member is L-shaped.

* * * * *